US012778373B2

(12) United States Patent
Hönnige et al.

(10) Patent No.: US 12,778,373 B2
(45) **Date of Patent: *Nov. 3, 2026**

(54) FLOOR CLEANING SYSTEM, FLOOR CLEANING APPARATUS, AND METHOD FOR OPERATING A FLOOR CLEANING SYSTEM OR A FLOOR CLEANING APPARATUS

(71) Applicant: ALFRED KÄRCHER SE & CO. KG, Winnenden (DE)

(72) Inventors: Heiko Hönnige, Winnenden (DE); Thilo Ehrentreich, Winnenden (DE); Patrick Prasser, Winnenden (DE); Manuel Drust, Winnenden (DE); Felipe Garcia Lopez, Winnenden (DE); Fabian Schurig, Munich (DE); Gereon Hinz, Munich (DE)

(73) Assignee: ALFRED KÄRCHER SE & CO. KG, Winnenden (DE)

( * ) Notice: Subject to any disclaimer, the term of this patent is extended or adjusted under 35 U.S.C. 154(b) by 282 days.

This patent is subject to a terminal disclaimer.

(21) Appl. No.: 18/418,469

(22) Filed: Jan. 22, 2024

(65) Prior Publication Data

US 2024/0172914 A1 May 30, 2024

Related U.S. Application Data

(63) Continuation of application No. PCT/EP2021/070744, filed on Jul. 23, 2021.

(51) Int. Cl.
*A47L 11/40* (2006.01)
*A47L 11/283* (2006.01)

(52) U.S. Cl.
CPC ..... *A47L 11/4061* (2013.01); *A47L 11/283* (2013.01); *A47L 2201/04* (2013.01); *A47L 2201/06* (2013.01)

(58) Field of Classification Search
CPC ..... A47L 2201/06; A47L 11/283; A47L 11/40
See application file for complete search history.

(56) References Cited

U.S. PATENT DOCUMENTS

2018/0281191 A1 10/2018 Sinyavskiy et al.
2019/0167059 A1 6/2019 Brown et al.
(Continued)

FOREIGN PATENT DOCUMENTS

DE 102019125469 3/2021
EP 3832418 6/2021
(Continued)

OTHER PUBLICATIONS

International Search Report and Written Opinion for International (PCT) Patent Application No. PCT/EP2021/070744, dated Mar. 25, 2022, 11 pages.
(Continued)

*Primary Examiner* — Michael D Jennings
(74) *Attorney, Agent, or Firm* — Sheridan Ross P.C.

(57) ABSTRACT

A floor cleaning system is provided that comprises a self-propelled and self-steering floor cleaning apparatus. At least one controllable display, at least one storage unit is provided with the system. Surroundings can be detected by a sensor unit and at least one cleaning path can be stored. At least one of a cleaning event and an interaction event can be stored in the cleaning path in a position-specific manner, and the cleaning path can be displayed on the at least one display unit in a manner that is associated with the at least one cleaning event and/or the at least one interaction event. Methods of operating such cleaning systems are further provided.

27 Claims, 8 Drawing Sheets

(56) References Cited

U.S. PATENT DOCUMENTS

| | | | | |
|---|---|---|---|---|
| 2019/0171210 | A1 | 6/2019 | Passot et al. | |
| 2020/0288936 | A1 | 9/2020 | Knutson et al. | |
| 2020/0368616 | A1* | 11/2020 | Delamont | A63F 13/52 |
| 2022/0378268 | A1 | 12/2022 | Denda et al. | |

FOREIGN PATENT DOCUMENTS

| | | | | |
|---|---|---|---|---|
| JP | H09-212238 | | 8/1997 | |
| JP | 2006-209644 | | 8/2006 | |
| JP | 2007-226322 | | 9/2007 | |
| JP | 2014-219723 | | 11/2014 | |
| JP | 2018-112917 | | 7/2018 | |
| JP | 2019-097533 | | 6/2019 | |
| JP | 2020-098404 | | 6/2020 | |
| JP | 2020-194415 | | 12/2020 | |
| KR | 10-2019-0030197 | | 3/2019 | |
| WO | WO 2017/173553 | | 10/2017 | |
| WO | WO 2021/106331 | | 6/2021 | |
| WO | WO-2023001389 | A1 * | 1/2023 | G05D 1/0221 |

OTHER PUBLICATIONS

"T7AMR Robotic Cleaning Machine | Product Overview | Tennant Company," Uploaded to YouTube by Tennant Equipment Insights, Nov. 12, 2018, retrieved from https://www.youtube.com/watch?v=MorsoYrtdtA, 2 pages.

"How Tennant Integrated a Robotics Solution into an Existing Product," Tennant, Feb. 20, 2019, 5 pages.

"T7AMR (Battery) Rider-Scrubber Operator Manual," Tennant, 2018, 68 pages.

* cited by examiner

FLOOR CLEANING SYSTEM, FLOOR CLEANING APPARATUS, AND METHOD FOR OPERATING A FLOOR CLEANING SYSTEM OR A FLOOR CLEANING APPARATUS

CROSS-REFERENCE TO RELATED APPLICATIONS

This application is a continuation application of international application number PCT/EP2021/070744, filed on Jul. 23, 2021, which is incorporated herein by reference in its entirety and for all purposes.

FIELD OF THE INVENTION

The present invention relates to a floor cleaning system comprising a self-propelled and self-steering floor cleaning apparatus for cleaning a floor surface; at least one controllable display unit; and at least one storage unit, wherein the floor cleaning apparatus comprises a running gear for traveling on a floor surface, a control unit, a sensor unit, at least one cleaning unit and an operating unit, wherein surroundings can be detected by means of the sensor unit in order to locate and/or navigate the floor cleaning apparatus, in particular during movement, wherein at least one cleaning path on the floor surface can be stored or is stored in the at least one storage unit, wherein the floor cleaning apparatus is designed and configured to create a cleaning path, which can be stored in the storage unit, in a teaching mode of operation while being guided by an operator at the operating unit.

The present invention further relates to a method for operating a floor cleaning system and a floor cleaning apparatus.

BACKGROUND OF THE INVENTION

An autonomous cleaning of the floor surface can be carried out with the floor cleaning apparatus of the floor cleaning system mentioned at the outset. Controlled by the control unit, the floor cleaning apparatus can travel over the floor surface and remove dirt by means of the at least one cleaning unit. It can be provided for cleaning liquid from a storage container to wet the floor surface in order to increase the cleaning efficiency. The at least one cleaning unit can comprise, for example, a cleaning roller or a disk brush. The mixture of dirt and cleaning liquid can be picked up from the floor surface, for example, by a suction strip and transferred to a dirty liquid container.

It is known that autonomous floor cleaning apparatuses can cover previously stored cleaning paths. The cleaning path is taught in a teaching mode of operation (also referred to as teach-in) and stored while the floor cleaning apparatus is being guided by an operator. For localization and/or navigation purposes, the floor cleaning apparatus can detect the surroundings using at least one signal of the sensor unit. In this way, the floor cleaning apparatus can find and cover, during a later cleaning process, the routes in the surroundings stored in the teaching mode of operation.

US 2020/0288936 A1 describes an autonomous floor cleaning apparatus with a teaching mode of operation.

An object underlying the present invention is to provide a floor cleaning system, a floor cleaning apparatus, and a method for operating a floor cleaning system, with which cleaning paths can be provided with additional information in particular with a view to controlling the cleaning result.

SUMMARY OF THE INVENTION

In a first aspect of the invention, a floor cleaning system comprises a self-propelled and self-steering floor cleaning apparatus for cleaning a floor surface, at least one controllable display unit, and at least one storage unit. The floor cleaning apparatus comprises a running gear for traveling on a floor surface, a control unit, a sensor unit, at least one cleaning unit and an operating unit. Surroundings can be detected by means of the sensor unit in order to locate and/or navigate the floor cleaning apparatus, in particular during movement. At least one cleaning path on the floor surface can be stored or is stored in the at least one storage unit. The floor cleaning apparatus is designed and configured to create a cleaning path, which can be stored in the storage unit, in a teaching mode of operation while being guided by an operator at the operating unit. At least one cleaning event relating in particular to the at least one cleaning unit, and/or at least one interaction event relating to an interaction of the floor cleaning apparatus with the surroundings can be stored or is stored in the cleaning path in a position-specific manner, and wherein the cleaning path can be displayed on the at least one display unit in a manner that is associated with the at least one cleaning event and/or the at least one interaction event.

In a second aspect of the invention, a floor cleaning apparatus in accordance with the first aspect is provided.

In a third aspect of the invention, a method for operating a floor cleaning system in accordance with the first aspect of the invention or of a floor cleaning apparatus in accordance with the second aspect of the invention is provided, wherein the cleaning path is displayed on the at least one display unit in a manner that is associated with the at least one cleaning event and/or the at least one interaction event.

BRIEF DESCRIPTION OF THE DRAWINGS

The foregoing summary and the following description may be better understood in conjunction with the drawing figures, of which.

DETAILED DESCRIPTION OF PREFERRED EMBODIMENTS OF THE INVENTION

Figure 1:
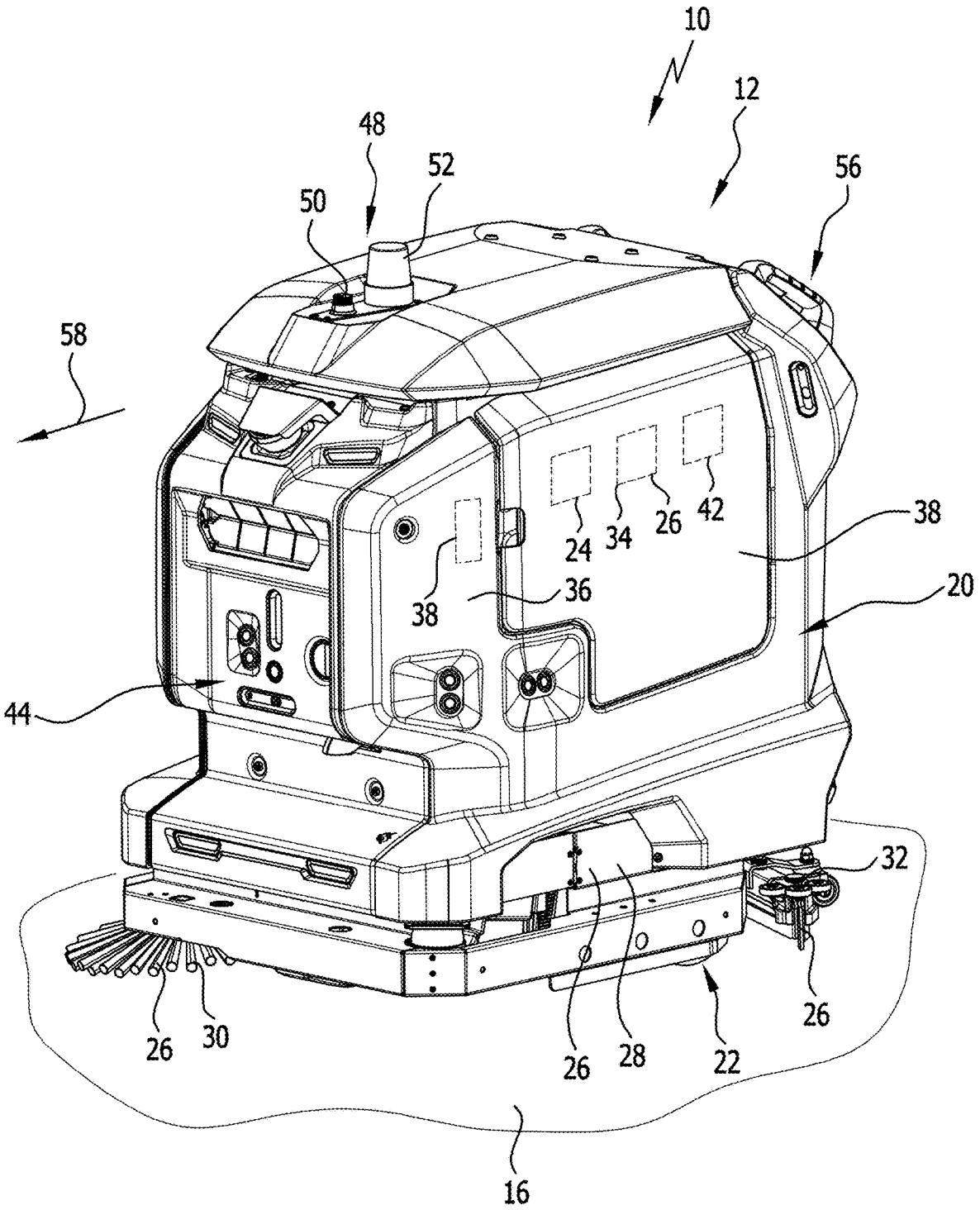
FIG. 1: shows a perspective representation of a floor cleaning apparatus in accordance with the invention.

Although the invention is illustrated and described herein with reference to specific embodiments, the invention is not intended to be limited to the details shown. Rather, various modifications may be made in the details within the scope and range of equivalents of the claims without departing from the invention.

The present invention relates to a floor cleaning system comprising: a self-propelled and self-steering floor cleaning apparatus for cleaning a floor surface; at least one controllable display unit; and at least one storage unit, wherein the floor cleaning apparatus comprises a running gear for traveling on a floor surface, a control unit, a sensor unit, at least one cleaning unit and an operating unit, wherein surroundings are detectable by means of the sensor unit in order to locate and/or navigate the floor cleaning apparatus, in particular during movement, wherein at least one cleaning path on the floor surface is storable or stored in the at least one storage unit, wherein the floor cleaning apparatus is designed and configured to create a cleaning path, which is storable in the storage unit, in a teaching mode of operation while being guided by an operator at the operating unit, and wherein at least one cleaning event relating in particular to the at least one cleaning unit, and/or at least one interaction event relating to an interaction of the floor cleaning apparatus with the surroundings is storable or stored in the cleaning path in a position-specific manner, and wherein the cleaning path is displayable on the at least one display unit in a manner that is associated with the at least one cleaning event and/or the at least one interaction event.

With the floor cleaning system in accordance with the invention, additional information about the at least one cleaning event and/or the at least one interaction event can be stored (for example during teach-in) or is stored (for example in case of a previously stored cleaning path) in the cleaning path. In addition to mere directions of travel and changes in the direction of travel, the cleaning path in the floor cleaning system in accordance with the invention comprises additional information which relates to the cleaning and/or to the interaction. The additional information can be displayed on the at least one display unit in the cleaning path in a position-specific manner. In this way, the operator can determine not only where the floor cleaning apparatus is or has been located, but also what state the floor cleaning apparatus takes or has taken with respect to cleaning and/or interaction.

It may be provided for a stored cleaning path to not have been taught via the floor cleaning apparatus, but to have been otherwise stored in the storage unit by an operator. For example, the cleaning path can be externally created and stored in the storage unit by an operator. For example, comprehensive planning of the cleaning is used as a basis for creating the cleaning path.

For creating the cleaning path, for example, the latter may be covered in full and sketched in a remote manner. Alternatively or additionally, it may be provided for the cleaning path to be partially covered and partially created by calculation on the basis of the route, for example when filling bypassed areas. Such semiautomatic creation is described in US 2012/0288936 A1.

It may be favorable for the cleaning path to be displayable on the at least one display unit while the floor cleaning apparatus is being guided by the operator in the teaching mode of operation, in particular in a manner that is associated with the at least one cleaning event and/or the at least one interaction event. As a result, the operator can visually check the route of the floor cleaning apparatus and any events already during the teaching mode of operation.

Preferably, the operating unit comprises at least one operating element for triggering the at least one cleaning event and/or the at least one interaction event by the operator in the teaching mode of operation. During the teaching mode of operation, the operator can actuate the operating element in order to trigger the desired event. A corresponding event can be stored in the cleaning path in a position-specific manner.

Preferably, a map of the surroundings is displayable on the at least one display unit, which map can be created for example by the control device on the basis of at least one signal of the sensor device. Favorably, the cleaning path can be displayed in the map, preferably during the teaching mode of operation. This gives the operator the chance to see and control which sections of the floor surface have already been covered and which sections are yet to be covered in order to complete the cleaning path, if necessary.

Having the cleaning path displayed on the map in the teaching mode of operation makes it easier for the operator to efficiently guide the floor cleaning apparatus. For example, this makes it easier for the operator to guide the floor cleaning apparatus over the floor surface in a manner close to edges or obstacles. As a result of the visual support, in case of, for example, a meandering or spiral movement, the operator can cover parallel tracks more easily and, at the same time, with the smallest possible overlapping of adjacent tracks.

It may be provided for the surroundings to be monitored in the teaching mode of operation and for instructions for guiding the floor cleaning apparatus to be output to the operator, for example when entering bottlenecks. The instructions can be visual and/or acoustic instructions.

It may be provided for a taught-in cleaning path to be improvable in a subsequent optimization step, for example by the control unit, wherein the optimized cleaning path is taken as a basis for the subsequent automatic execution by the floor cleaning apparatus. During optimization, for example, adjustments with regard to collision avoidance, safety requirements, parallel course of adjacent tracks, cleaning close to edges, avoidance of implausible or redundant movements, and/or a different type of criterion are made.

In a preferred embodiment of the invention, the at least one cleaning event can, for example, be at least one of the following:

- switching on or off a cleaning operation;
- switching on, switching off, and/or changing the operating state of at least one cleaning unit;
- setting a dosing of a cleaning liquid and/or of a cleaning chemical;
- a traveling speed of the floor cleaning apparatus on the floor surface, in particular during cleaning of the floor surface.

The floor cleaning apparatus preferably comprises an indication unit with an optical actuator and/or an acoustic actuator, wherein the at least one interaction event comprises outputting an indication via the optical actuator and/or the acoustic actuator. For example, a signal light, a blinking light, a loudspeaker, and/or a horn are provided as actuators. The floor cleaning apparatus can interact with the surroundings, in particular people, via the at least one actuator. For example, the surroundings can be made aware of the floor cleaning apparatus optically and/or acoustically. Preferably, this is also possible if no people are detected in the surroundings by the floor cleaning apparatus.

It is advantageous if the cleaning path can be displayed, in particular in a manner that is associated with the at least one cleaning event and/or the at least one interaction event, during and/or upon completion of a cleaning process automatically carried out by the floor cleaning apparatus while covering a previously stored cleaning path. This allows for controlling the covered cleaning path as to the cleaning result even during the autonomous execution of the work or upon completion thereof.

For example, after completion of the cleaning process, a cleaning report can be created and stored in the at least one storage unit, wherein the cleaning path is part of the cleaning report, in particular in a manner that is associated with the at least one cleaning event and/or the at least one interaction event.

It is advantageous if a previously stored cleaning path together with the cleaning path actually covered during the cleaning process can be displayed by the control unit. In this case, it is preferably provided for any deviations between the cleaning paths to be visualizable on the display unit. In this way, for example, obstacle avoidance maneuvers of the floor cleaning apparatus can be detected. Deviations between the cleaning paths can, for example, suggest a poorly taught-in cleaning path, a change in the position of obstacles at or on the floor surface, and/or insufficient calibration of the sensor unit.

It is advantageous if the control unit can calculate a match between the actually covered cleaning path and the previously stored cleaning path. This allows for calculating a coverage and determining the extent to which it was possible to actually provide the desired cleaning by traveling the cleaning path.

The at least one cleaning event and/or interaction event can be displayed on the display unit in various ways. For example, events are marked via a marker element on or next to the path at the time of their occurrence. Optionally, an explanation as to the type of the event may be provided. The event may be displayed, for example, for the duration of its occurrence as a coloring or highlighting of the route of the cleaning path.

Preferably, the cleaning path can be displayed on the display unit such that the at least one cleaning event and/or the at least one interaction event can optionally be displayed. In the present case, this can be understood to mean in particular that the operator can select whether and possibly which cleaning event and/or interaction event is displayed on the display unit. For example, a plurality of virtual layers each comprising information about at least one event may be displayed on the display unit. It may be provided for the operator to be able to specifically have the contents of one layer or multiple layers displayed.

It may be favorable if the cleaning path can be displayed on the display unit such that at least one of the following is highlighted:

- a section of the cleaning path along which a cleaning operation is or was performed;
- a section of the cleaning path along which at least one cleaning unit is or was in operation.

Highlighting can take place, for example, by coloring the route of the cleaning path.

It may be advantageous if the cleaning path can be displayed on the display unit such that a region of the floor surface covered by the at least one cleaning unit is highlighted, wherein highlighting can take place, for example, by coloring. For example, on the basis of the determined position information and known extension of the at least one cleaning unit it may be determined which region of the floor surface was covered by the cleaning unit. This can be visualized to the operator in order to facilitate the teach-in of the cleaning path and/or to determine which regions of the floor surface have or have not already been cleaned.

The at least one display unit is, for example, a touch-sensitive display unit. For example, a touch-sensitive screen (touchscreen) may be provided. The operator can preferably make inputs via the touch-sensitive display unit. Operating elements may be implemented, for example, as so-called "soft keys."

A gesture control may be provided on the touch-sensitive display unit. This proves to be advantageous, for example, if the cleaning path can be displayed on the display unit in an enlarged and/or reduced manner.

It may be provided for the floor cleaning apparatus to comprise at least one display unit which is preferably arranged on the operating unit and may, for example, form part of the operating unit or the operating unit as a whole.

In a preferred embodiment of the invention, it may be provided for at least one display unit to be positioned remote from the floor cleaning apparatus, wherein image information can be transmitted from the floor cleaning apparatus to the display unit via a communication unit. In this way, it is possible to control the cleaning result in particular after automatic cleaning, for example in a remote station.

For example, the floor cleaning system comprises a data processing device which has the display unit. The data processing device may be designed centrally or in a spatially distributed manner, for example via a cloud service.

It may be provided for the floor cleaning apparatus to comprise at least one storage unit. In this way, cleaning paths can be stored locally in the floor cleaning apparatus.

In a preferred embodiment of the invention, it may be provided for at least one storage unit to be positioned remote from the floor cleaning apparatus, wherein information that is to be stored or is stored can be transmitted from the floor cleaning apparatus to the storage unit and/or vice versa via a communication unit. For example, storing in a manner that is remote from the floor cleaning apparatus allows for having cleaning paths covered by different floor cleaning apparatuses in a technically simple manner, wherein for this purpose the cleaning paths do not have to be stored in multiple floor cleaning apparatuses. This is advantageous, for example, when changing between floor cleaning apparatuses or in case of floor cleaning apparatus maintenances and/or malfunctions.

It may be provided for the floor cleaning system to comprise a (central and/or cloud service) data processing device which has the storage unit.

In a preferred embodiment of the invention, the floor cleaning apparatus may be designed as a scrubber vacuum.

The invention also relates to a floor cleaning apparatus in accordance with the invention which is a floor cleaning apparatus of a floor cleaning system of the type described above. Advantageous embodiments of the floor cleaning apparatus in accordance with the invention result from the above explanations.

As mentioned at the outset, the present invention also relates to a method. A method in accordance with the invention for operating a floor cleaning system or floor cleaning apparatus solves the problem set at the beginning in that a floor cleaning system or a floor cleaning apparatus of the type described above is used, wherein the cleaning path can be displayed on the at least one display unit in a manner that is associated with the at least one cleaning event and/or the at least one interaction event.

FIG. 1 shows an advantageous embodiment of a floor cleaning apparatus in accordance with the invention, which is denoted overall by reference numeral 10. The floor cleaning apparatus 10 on its own can form a floor cleaning system in accordance with the invention in a preferred embodiment, characterized by reference numeral 12.

Figure 10:
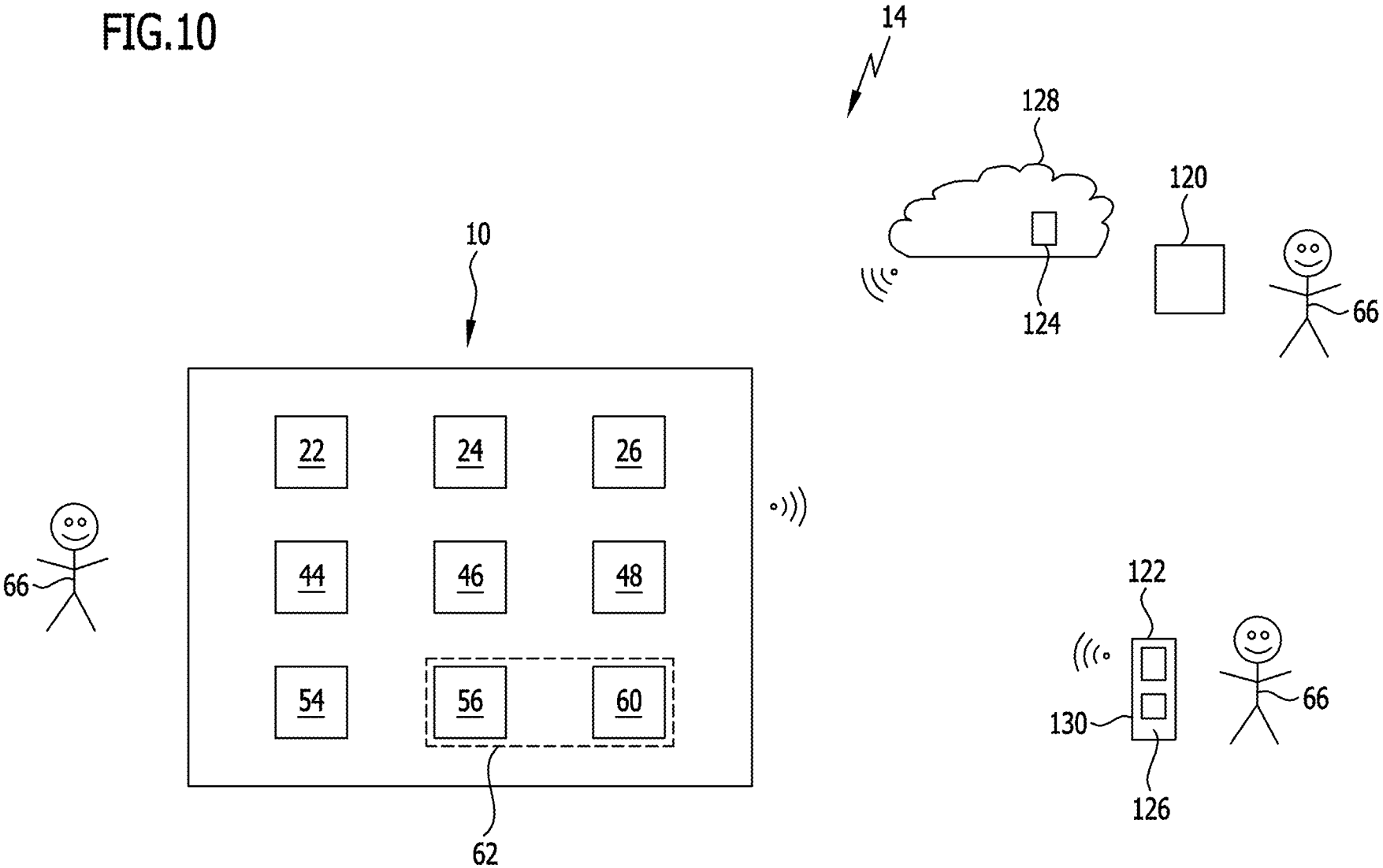
FIG. 10: shows a floor cleaning system in accordance with the invention, comprising the floor cleaning apparatus.

Alternatively or additionally, the floor cleaning apparatus 10 may be part of a further floor cleaning system 14 in accordance with the invention shown schematically in FIG. 10 in a preferred embodiment.

The floor cleaning apparatus 10 is designed to be self-propelled and self-steering and, in particular, forms a cleaning robot. Autonomous cleaning of a floor surface 16 within surroundings 18 can be carried out with the floor cleaning apparatus 10. With the floor cleaning apparatus 10 it is possible, in particular, to cover cleaning paths previously stored and to clean the floor surface 16. The cleaning paths can be taught in or specified in a teaching mode of operation (teach-in).

Figure 2:
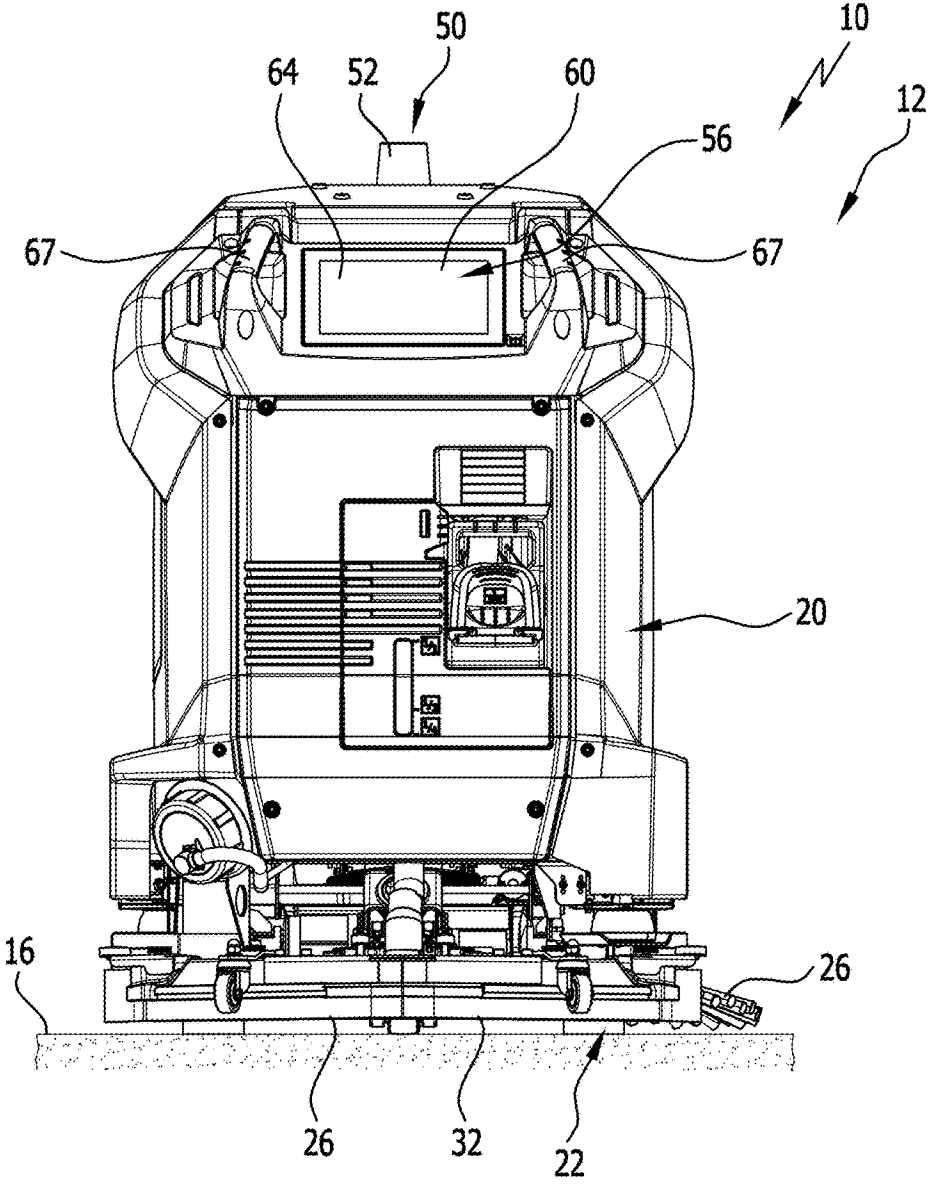
FIG. 2: shows a rear view of the floor cleaning apparatus from FIG. 1.

As follows in particular from FIGS. 1, 2, and 10, the floor cleaning apparatus 10 comprises a housing 20 with a running gear 22 arranged underneath.

Position and orientation information relates to an intended use of the floor cleaning apparatus 10, in which it can stand on the floor surface 16 via the running gear 22.

The floor cleaning apparatus comprises a control unit 10 for controlling all processes. The floor cleaning apparatus 10 comprises cleaning units 26 for cleaning the floor surface 16. In the present example, the cleaning units 26 comprise a floor cleaning head 28 with roller brushes (not shown in the drawing), a side broom 30, a suction strip 32, and a suction unit 34 for applying negative pressure to the suction strip 32.

The floor cleaning apparatus 10 comprises a storage container 36 for a cleaning liquid, in particular water, and a storage container 38 for a cleaning chemical.

The floor surface 16 is wetted with the mixture of water and cleaning chemical. The dirt is removed by means of the cleaning units 26 and transferred to a dirty liquid container 40 via the suction strip 32 and under the effect of the suction unit 34.

The floor cleaning apparatus 10 comprises a rechargeable, in particular electrical, battery 42 for power supply.

The floor cleaning apparatus 10 further comprises a sensor unit 44 which may comprise, for example, at least one stereo camera system, a lidar system, and/or an ultrasound system. The control unit 24 can localize and/or navigate the floor cleaning apparatus 10 in its surroundings 18 on the basis of at least one signal of the sensor unit 44.

The floor cleaning apparatus 10 further comprises a storage unit 46. In particular, multiple cleaning paths can be stored in and memorized by the storage unit 46.

The floor cleaning apparatus 10 further comprises an indication unit 48. In the present case, the indication unit comprises at least one acoustic actuator 50, for example designed as a horn or loudspeaker, and at least one optical actuator 52, for example designed as a blinking light.

The floor cleaning apparatus 10 can interact with the surroundings via the indication unit 48. In the present case, this can be understood to mean, in particular, that acoustic and/or visual indications directed in particular to persons are output via the actuators 50 and/or 52.

The floor cleaning apparatus 10 further comprises a communication unit 54 via which information can be transmitted in a wireless and/or wired manner from the floor cleaning apparatus 10 and to the floor cleaning apparatus 10.

The floor cleaning apparatus 10 moreover has an operating unit 56 which in relation to a forward direction 58 is arranged on the rear side. A controllable display unit 60 is provided which may be part of, or may at least partially form, the operating unit 56. This is schematically indicated by a dashed line 62 in FIG. 10.

In the present case, the display unit 60 is designed to be touch-sensitive and in particular a touchscreen 64 with image display, which is preferably colored. The touchscreen 64 allows for accepting user inputs and preferably supports gesture control.

Figure 3:
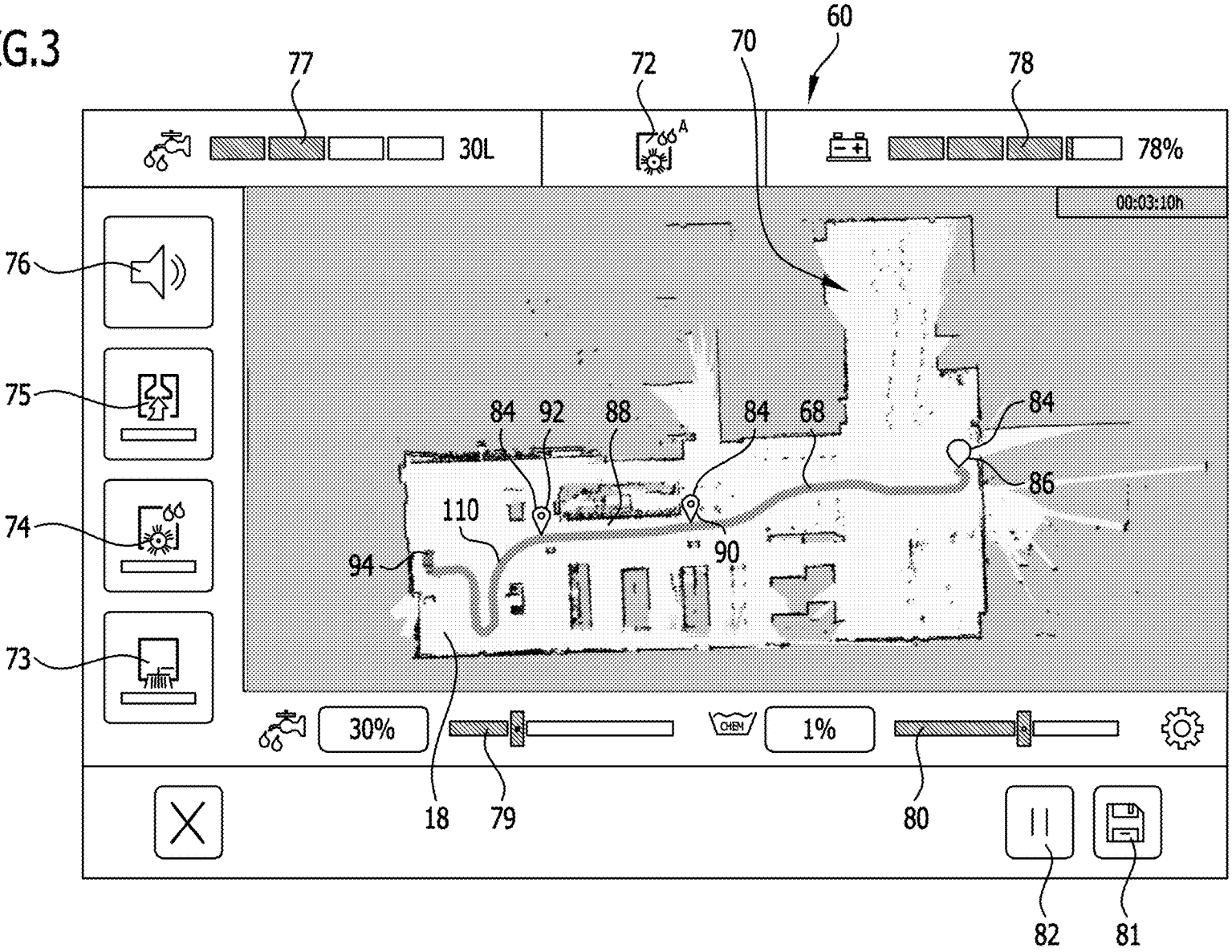
FIG. 3: shows an enlarged representation of a display unit of the floor cleaning apparatus in a teaching mode of operation.
Figure 4:
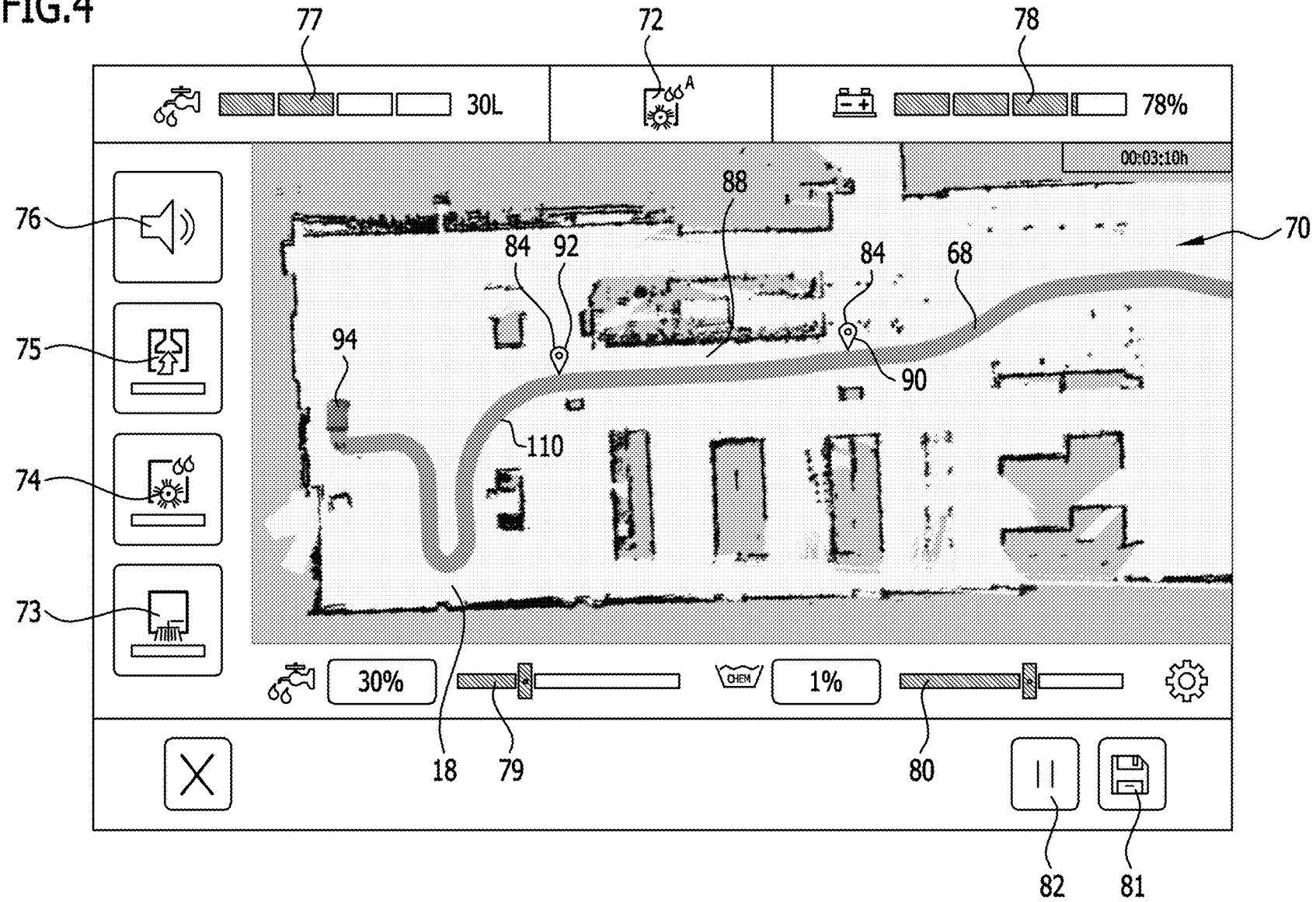
FIG. 4: shows an illustration corresponding to FIG. 3 with different display content of the display unit.

FIGS. 3 and 4 show the image content of the display unit 60 while an operator 66 operates the floor cleaning apparatus 10 in a teaching mode of operation. The aim of the teach-in is to create a cleaning path 68 within the surroundings 18 that is stored in the storage unit 46 and can automatically be covered by the floor cleaning apparatus 10 at a later point in time in order to carry out a cleaning of the floor surface 16.

The operator 66 can guide the floor cleaning apparatus 10 via grip elements 67 of the operating unit 56 during the teach-in. The running gear 62 can be influenced via drive levers arranged on the grip elements 67.

FIGS. 3 and 4 show a map 70 of the surroundings 18 which is automatically created by the floor cleaning apparatus 10 during the teach-in, wherein a map section has been enlarged by the user in FIG. 4 compared to the representation in accordance with FIG. 3.

Further, an operating element 72 for selecting a cleaning mode, an operating element 73 for switching on/off the side broom 30, an operating element 74 for switching on/off the floor cleaning head 28, an operating element 75 for switching on/off the suction unit 34, and an operating element 76 for switching on/off the instructions unit 48 are shown on the display unit 60.

Further, a display element 77 for displaying the water supply, a display element 78 for displaying the battery capacity, a display element 79 for displaying the metering of water, and a display element 80 for displaying the metering of the cleaning chemical are shown on the display unit 60.

The cleaning path 68 can be stored via an actuating element 81. Recording of the cleaning path 68 can be interrupted via an actuating element 82.

As explained at the beginning, it is provided in accordance with the invention that at least one cleaning event, which in particular relates to the at least one cleaning unit 26, and/or at least one interaction event can be stored in the cleaning path 68 in a position-specific manner. Preferably, it is possible to represent these events on the display unit 60 even in the teaching mode of operation. This is shown in FIGS. 3 and 4. In the present example, events are shown on the display unit 60 via marker elements 84 which may be provided, for example, with a text for explaining to the operator 66.

Starting from a starting point 86, the floor cleaning apparatus 10 in the surroundings 18 has been moved first over a region, which is designed to be relatively free of obstacles, and up to a narrowed region 88. To warn the surroundings 18, the operator 66 has triggered an interaction event of the indication unit 48 via the actuating element 76, which interaction event is stored in the cleaning path 68. The interaction event is shown with reference sign 90 in a position-specific manner.

After an initial empty trip, cleaning of the floor surface 16 has started in that the operator 66 has activated the cleaning units 26 via the operating elements 73 to 75 (cleaning event 92). A symbol 94 identifies the present position of the floor cleaning apparatus 10 within the surroundings 18 along the cleaning path 68.

A rendering of the map 70 allows the operator 66 to determine which sections of the floor surface 16 have not yet been covered. Based on this, the operator 66 is supported to create the cleaning path 68. Regions that have not been covered yet can be approached in a targeted manner. Tracks of the cleaning path 68 can be placed next to one another for the purpose of cleaning the whole surface, wherein the smallest possible overlap can be achieved at the same time. Cleaning close to edges or obstacles is also supported by rendering the map.

Cleaning events and interaction events that were triggered by the operator 66 during the teach-in are stored as part of the cleaning path 68, together with the route covered.

During automatic cleaning while covering the cleaning path 68, the events are triggered by the floor cleaning apparatus 10 as specified by the operator 66 in a position-specific manner. Furthermore, the cleaning path 68, including events, can be displayed on the display unit 60 after completion of the cleaning and preferably also during cleaning, which will be discussed below with reference to FIGS. 5 to 9. Preferably, after completion of the cleaning, a cleaning report can be created and stored in the storage unit 46, based on which the cleaning result can be controlled.

The following example is explained on the basis of a cleaning path 68 which differs from the cleaning path 68 according to FIGS. 3 and 4. The same applies to the surroundings 18 and thus to the map 70. In the present case, the difference between the cleaning paths 68 serves to explain that different cleaning paths can be trained and worked off.

Figure 5:
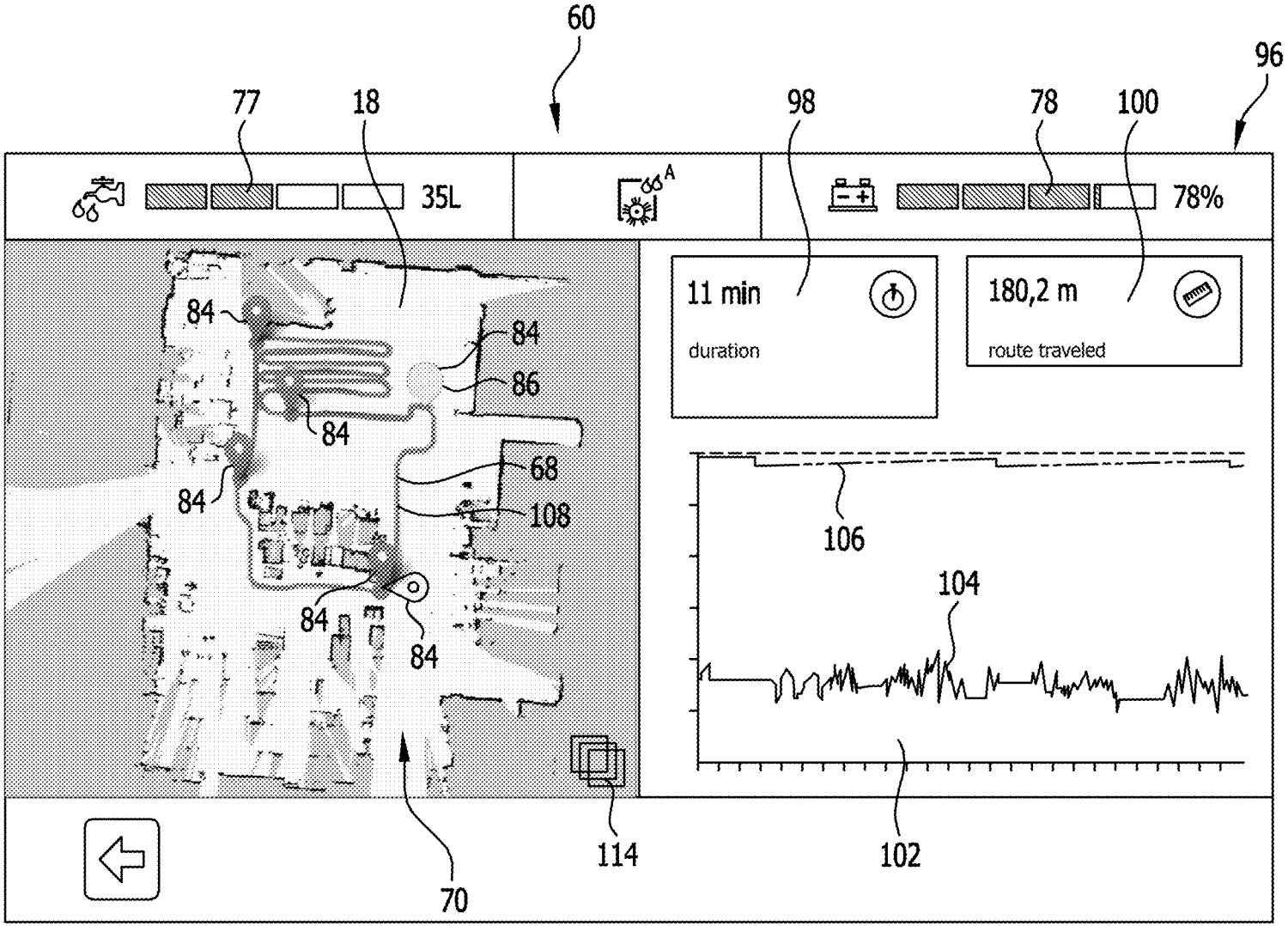
FIG. 5: shows a further representation of the display unit of the floor cleaning apparatus after completion of a cleaning process.

Rendering of the cleaning report 96 on the display unit 60 in accordance with FIG. 5 comprises displaying the map 70 with the cleaning path 68 shown therein and preferably marker elements 84 that can be displayed or hidden optionally and by the operator.

Furthermore, display elements 77 and 78, a display element 98 with information about the travel time, and a display element 100 with information about the distance covered are shown. A display element 102 can show, for example, a profile 104 of the remaining amount of water and a profile 106 of the remaining battery capacity as a function of time.

As can be seen in particular from FIGS. 6 to 9, multiple events were triggered for the cleaning path 68, based on the preceding saving.

Starting from a starting point 86, an empty trip has been made first. While driving around an obstacle 108, an interaction event 90 for warning persons in the surroundings 18 was triggered. A cleaning event 92 was triggered at the same point during which the cleaning units 26 are put into operation. A further cleaning event 92 was triggered, wherein the cleaning units 26 are put out of operation.

After a subsequent empty trip, a further cleaning event 92 was triggered, during which the cleaning units 26 are put into operation again. The cleaning units 26 were put out of operation during a further cleaning event 92. The trip to the end point, which in the present example corresponds to the starting point 86, was made as an empty trip.

The events and their identification can optionally be displayed by the operator 66 on the display unit 60 and, for example, displayed to cross-fade the route 110 or shown next to it. In addition to the marker element 84, the display can comprise, for example, an explanation 112 of the respective event.

The respective display mode can be selected by the operator 66. For this purpose, a corresponding operating element 114 can be selected on the display unit 60, for example. Preferably, virtual layers which have different information about the cleaning events and/or interaction events can be selectively displayed or masked out via the operating element 114.

It is possible, in particular, to show which cleaning unit 26 was activated at which sections of the cleaning path 68. This is done, for example, by highlighting the cleaning path 68 or showing it on the cleaning path 68. Highlighting can comprise a coloring.

Figure 7:
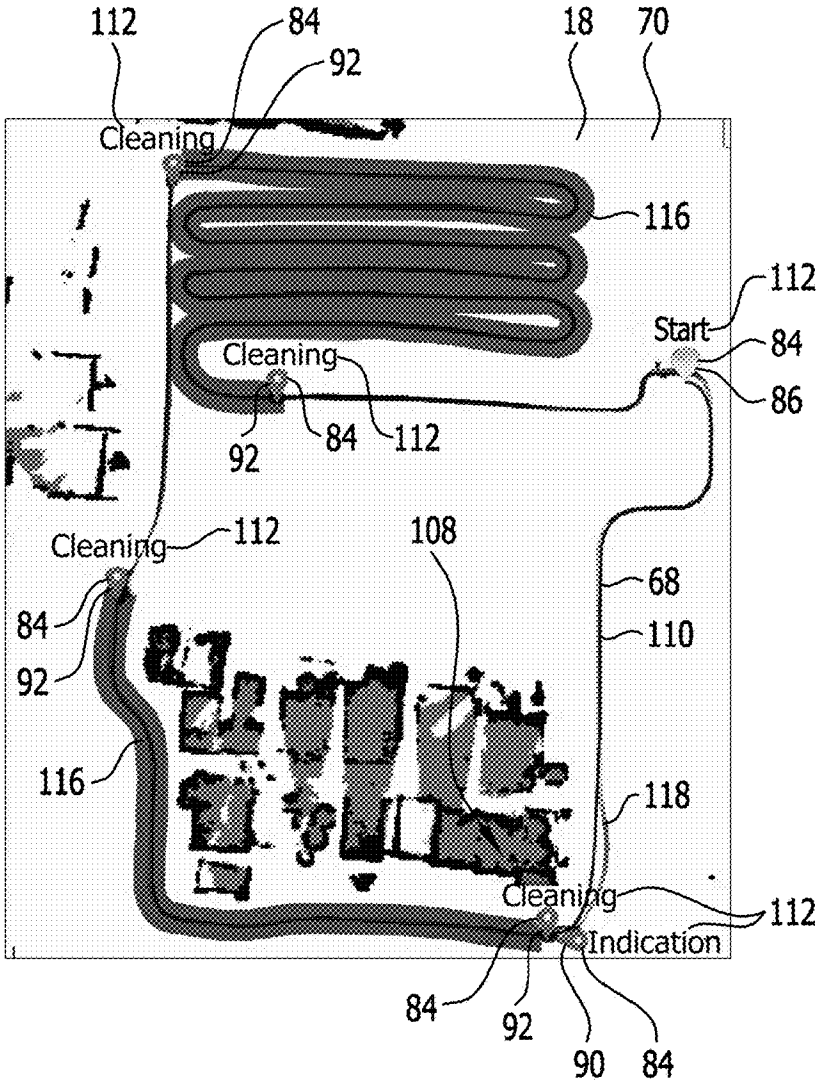
FIGS. 7 to 9: show further enlarged representations of the display content.
Figure 6:
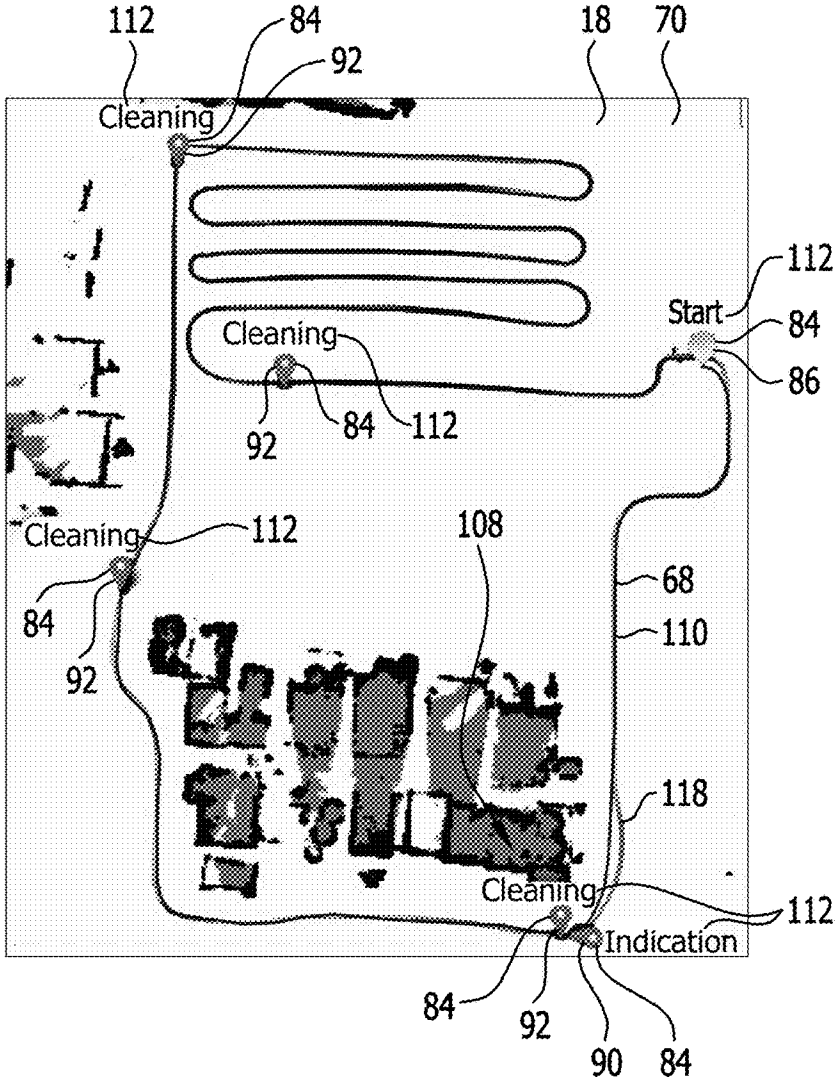
FIG. 6: shows an enlarged representation of the display content from FIG. 5.

FIG. 7 shows, in form of a highlighting 116, on which section of the cleaning path 68 the floor cleaning head 28 was switched on. Furthermore, it is shown which section of the floor surface 16 was covered by the floor cleaning head 28.

Figure 8:
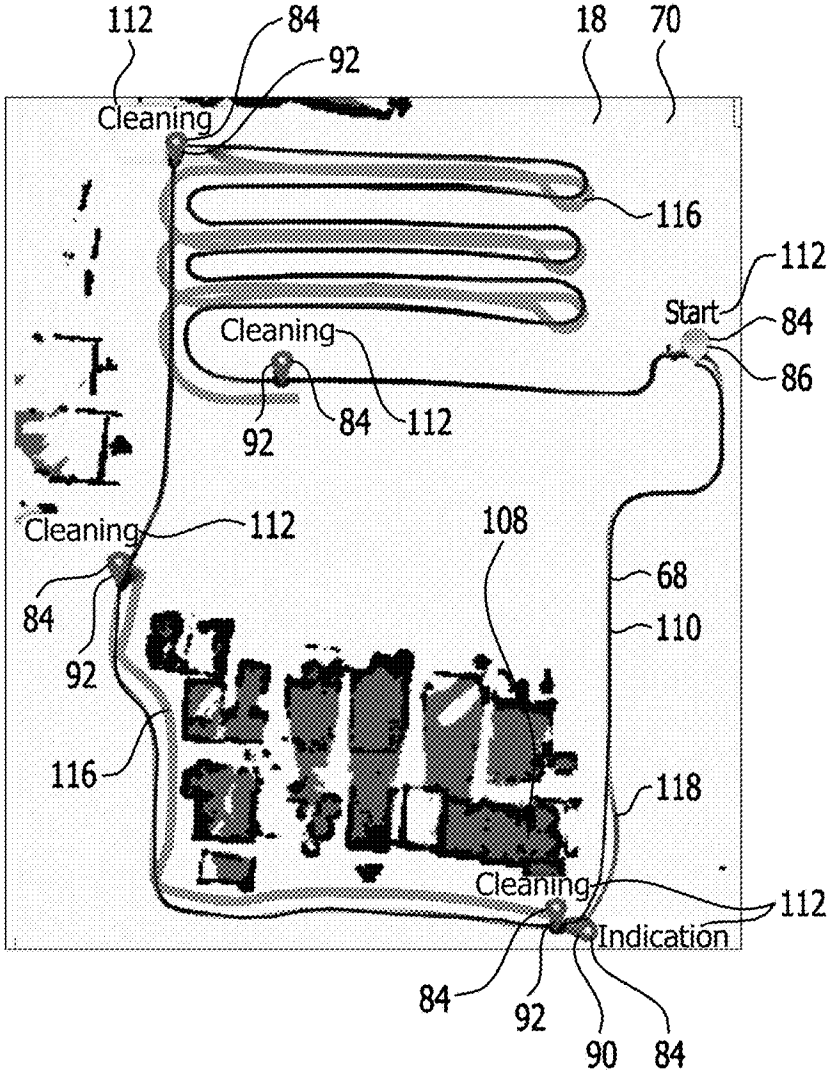

FIG. 8 shows the corresponding situation for the side broom 30 by a highlighting 116. It can also be seen which section of the floor surface 16 was covered by the side broom 30.

Figure 9:
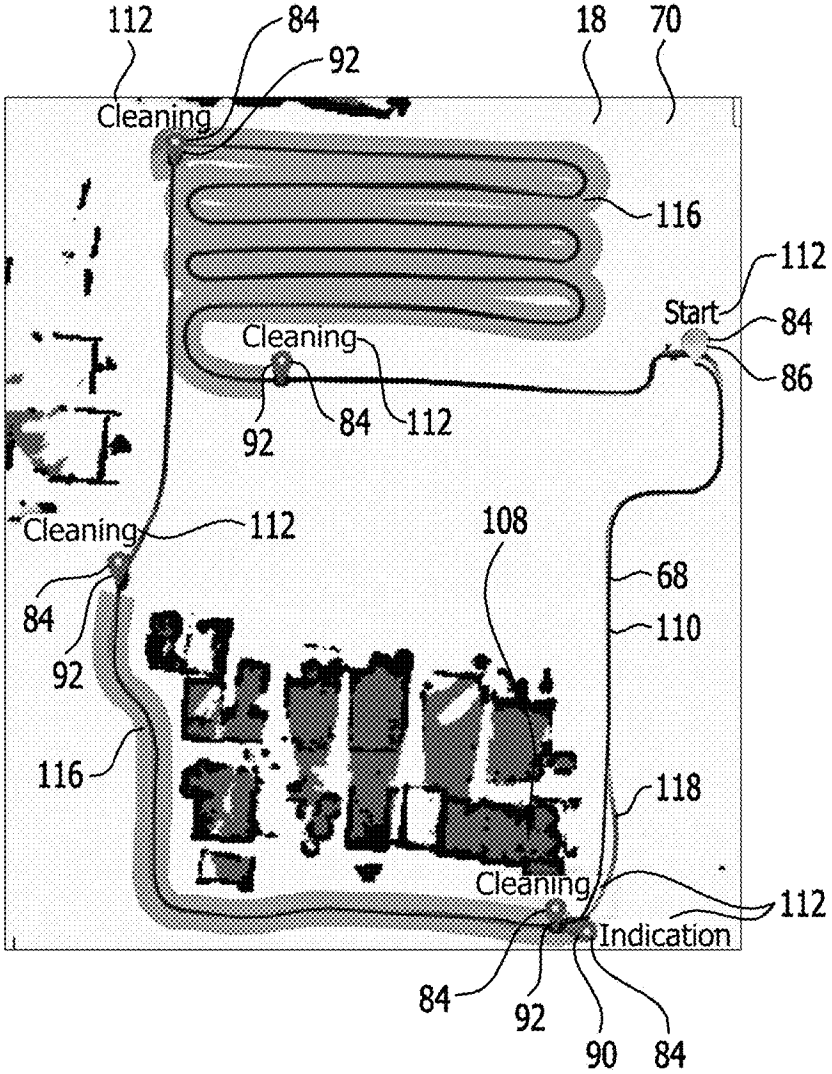

FIG. 9 shows, in form of a highlighting 116, at which sections of the cleaning path 68 the suction unit 34 was in operation.

The examples of FIGS. 7 to 9 show that the floor cleaning head 28, the side broom 30, and the suction unit 34 have each been activated and deactivated at the same time during the respective cleaning events 92. Of course, it can also be provided that depending on the teach-in, the events are triggered by the operator 66 for different types of cleaning units 26 at different points in time.

It can also be seen from FIGS. 6 to 9 that there was a deviation 118 between the learned cleaning path 68 and the covered cleaning path 68, where the floor cleaning apparatus 10 departed from the predetermined cleaning path 68. The deviation 118 can, for example, be attributed to an avoidance maneuver of the floor cleaning apparatus 10 in order to drive around an obstacle. Upon accumulation of deviations and/or particularly large deviations, the operator 66 may possibly make changes to the cleaning path 68, teach a new cleaning path, and/or service the floor cleaning apparatus 10.

It may be provided for a speed of the floor cleaning apparatus 10 to be displayed in the cleaning path 68. For example, the speed of the floor cleaning apparatus 10 can be seen on the basis of a coloring of the route 110.

FIG. 10 shows the floor cleaning system 14 with display units 120, 122 and storage units 124, 126. The display unit 120 is shown, by way of example, as a display unit of a data processing device 128, which may be a cloud service. The data processing device 128 further comprises the storage unit 124.

A portable accessory device 130, for example a smartphone or a tablet computer, comprises the display unit 122 and the storage unit 126.

Image information, for example as part of the cleaning report 96, can be transmitted by the floor cleaning apparatus 10 to the display on the display units 120 and/or 122 via the communication unit 54. This is particularly suitable for viewing and evaluating cleaning reports 96. Cleaning reports 96 can be stored, for example, in the storage units 124, 126.

Preferably cleaning paths 68 can be stored in the storage units 124, 126, wherein data relating thereto can be transmitted to the floor cleaning apparatus 10 via the communication unit 54. Conversely, information can be stored by the floor cleaning apparatus 10 in the storage units 124, 126, for example when learning cleaning paths 68.

LIST OF REFERENCE SIGNS

Floor cleaning apparatus
12, 14 Floor cleaning system
16 Floor surface
18 Surroundings

20 Housing
22 Running gear
24 Control unit
26 Cleaning unit
28 Floor cleaning head
30 Side broom
32 Suction strip
34 Suction unit
36, 38 Storage container
40 Dirty liquid container
42 Battery
44 Sensor unit
46 Storage unit
48 Indication unit
50, 52 Actuator
54 Communication unit
56 Control unit
58 Forward direction
60 Display unit
62 Dashed line
64 Touchscreen
66 Operator
67 Grip element
68 Cleaning path
70 Map
72, 73, 74, 75, 76 Operating element
77, 78, 79, 80 Display element
81, 82 Actuating element
84 Marker element
86 Starting point
88 Narrowed region
90 Interaction event
92 Cleaning event
94 Symbol
96 Cleaning report
98, 100, 102 Display element
104, 106 Profile
108 Obstacle
110 Route
112 Explanation
114 Control element
116 Highlighting
118 Deviation
120, 122 Display unit
124, 126 Storage unit
128 Data processing device
130 Accessory device

What is claimed is:

1. A floor cleaning system comprising:

a self-propelled and self-steering floor cleaning apparatus for cleaning a floor surface;

at least one controllable display unit;

and at least one storage unit, wherein the floor cleaning apparatus comprises a running gear for traveling on the floor surface, a control unit, a sensor unit, at least one cleaning unit, and an operating unit, wherein surroundings are detectable by means of the sensor unit in order to locate and/or navigate the floor cleaning apparatus, during movement, wherein at least one cleaning path on the floor surface is storable or stored in the at least one storage unit, wherein the floor cleaning apparatus is designed and configured to create a cleaning path, which is storable in the storage unit, in a teaching mode of operation while being guided by an operator at the operating unit, and wherein at least one interaction event relating to an interaction of the floor cleaning apparatus with the surroundings is storable or stored in the cleaning path in a position-specific manner, wherein the cleaning path is displayable on the at least one display unit in a manner that is associated with the at least one interaction event, and wherein the floor cleaning apparatus comprises an indication unit having an optical actuator and/or an acoustic actuator, and wherein the at least one interaction event comprises the output of an indication via the optical actuator and/or the acoustic actuator.

2. The floor cleaning system in accordance with claim 1, wherein the cleaning path is displayable on the at least one display unit while the floor cleaning apparatus is being guided by the operator in the teaching mode of operation.

3. The floor cleaning system in accordance with claim 1, wherein the operating unit comprises at least one operating element for triggering the at least one interaction event by the operator in the teaching mode of operation.

4. The floor cleaning system in accordance with claim 1, wherein a map of the surroundings is displayable on the at least one display unit, and wherein the cleaning path is displayable in the map.

5. The floor cleaning system in accordance with claim 1, wherein the cleaning path is displayable during and/or upon completion of a cleaning process automatically carried out by the floor cleaning apparatus, while covering a previously stored cleaning path.

6. The floor cleaning system in accordance with claim 1, wherein, after completion of the cleaning process, a cleaning report is creatable and is storable in the at least one storage unit, wherein the cleaning path is part of the cleaning report.

7. The floor cleaning system in accordance with claim 1, wherein a previously stored cleaning path together with the cleaning path actually covered during the cleaning process is displayable by the control unit.

8. The floor cleaning system in accordance with claim 7, wherein any deviations between the cleaning paths are visualizable on the display unit.

9. The floor cleaning system in accordance with claim 1, wherein a match between the actually covered cleaning path and the previously stored cleaning path is calculable by the control unit.

10. The floor cleaning system in accordance with claim 1, wherein the cleaning path is displayable on the display unit in a manner such that the at least one interaction event is optionally displayable.

11. The floor cleaning system in accordance with claim 1, wherein the cleaning path is displayed on the display unit in a manner such that at least one of the following is highlighted:

a section of the cleaning path along which a cleaning operation is or was performed;

a section of the cleaning path along which at least one cleaning unit is or was in operation.

12. The floor cleaning system in accordance with claim 1, wherein the cleaning path is displayable on the display unit in a manner such that a region of the floor surface covered by the at least one cleaning unit is highlighted.

13. The floor cleaning system in accordance with claim 1, wherein at least one display unit is a touch-sensitive display unit.

14. The floor cleaning system in accordance with claim 1, wherein the cleaning path is displayable on the display unit in an enlarged and/or reduced manner.

15. The floor cleaning system in accordance with claim 1, wherein the floor cleaning apparatus comprises at least one display unit.

16. The floor cleaning system in accordance with claim 15, wherein at least one display unit is positioned remote from the floor cleaning apparatus, wherein image information are transmittable from the floor cleaning apparatus to the display unit via a communication unit.

17. The floor cleaning system in accordance with claim 16, wherein the floor cleaning system comprises a data processing device which has the display unit.

18. The floor cleaning system in accordance with claim 1, wherein the floor cleaning apparatus comprises a storage unit of the at least one storage unit.

19. The floor cleaning system in accordance with claim 18, wherein a storage unit of the at least one storage unit is positioned remote from the floor cleaning apparatus, wherein information that is to be stored or is stored is transmittable from the floor cleaning apparatus to the storage unit and/or vice versa via a communication unit.

20. The floor cleaning system in accordance with claim 19, wherein the floor cleaning system comprises a data processing device which has the storage unit.

21. The floor cleaning system in accordance with claim 1, wherein the floor cleaning apparatus is designed as a scrubber vacuum.

22. A floor cleaning apparatus of a floor cleaning system in accordance with the invention in accordance with claim 1.

23. A method for operating a floor cleaning system in accordance with claim 1 or of a floor cleaning apparatus in accordance with claim 22, wherein the cleaning path is displayed on the at least one display unit in a manner that is associated with the at least one cleaning event and/or the at least one interaction event.

24. The floor cleaning system in accordance with claim 1, wherein at least one cleaning event is storable or stored in the cleaning path in a position-specific manner, wherein the cleaning path is displayable on the at least one display unit in a manner that is associated with the at least one cleaning event.

25. The floor cleaning system in accordance with claim 24, wherein the at least one cleaning event is at least one of the following:

- the at least one cleaning event is related to the at least one cleaning unit;
- switching on or off a cleaning operation;
- switching on, switching off, and/or changing the operating state of at least one cleaning unit;
- switching on, switching off, and/or changing a cleaning mode of the floor cleaning apparatus;
- setting a dosing of a cleaning liquid and/or of a cleaning chemical;
- setting and/or changing a traveling speed of the floor cleaning apparatus on the floor surface, during cleaning of the floor surface.

26. The floor cleaning system in accordance with claim 24, wherein the operating unit comprises at least one operating element for triggering the at least one cleaning event by the operator in the teaching mode of operation.

27. The floor cleaning system in accordance with claim 24, wherein the cleaning path is displayable on the display unit in a manner such that the at least one cleaning event is optionally displayable.

* * * * *